US010602793B1

(12) United States Patent
Williams

(10) Patent No.: US 10,602,793 B1
(45) Date of Patent: Mar. 31, 2020

(54) ANTI-CONCUSSION COLLAR ASSEMBLY AND METHOD OF USE

(71) Applicant: Brian Alfred Williams, Jupiter, FL (US)

(72) Inventor: Brian Alfred Williams, Jupiter, FL (US)

( * ) Notice: Subject to any disclaimer, the term of this patent is extended or adjusted under 35 U.S.C. 154(b) by 18 days.

(21) Appl. No.: 16/120,277

(22) Filed: Sep. 2, 2018

(51) Int. Cl.
*A42B 3/04* (2006.01)
*A63B 71/12* (2006.01)

(52) U.S. Cl.
CPC ..... *A42B 3/0473* (2013.01); *A63B 71/1291* (2013.01)

(58) Field of Classification Search
CPC ... A42B 3/0473; A63B 71/1291; A63B 71/10; A41D 13/0512
USPC ..... 2/425, 44, 468, 411, 459, 415; 602/17, 602/18
See application file for complete search history.

(56) References Cited

U.S. PATENT DOCUMENTS 3,134,106 A * 5/1964 Shaffer ..... A63B 71/1291 2/462
3,818,509 A 6/1974 Romo et al.
3,873,996 A 4/1975 Varteressian
4,094,015 A 6/1978 Howard
4,219,193 A 8/1980 Newman
4,821,339 A 4/1989 Fair
4,825,476 A * 5/1989 Andrews ..... A42B 3/0473 2/421
4,996,720 A 3/1991 Fair
5,371,905 A 12/1994 Kern
5,444,870 A 8/1995 Pinsen
5,517,699 A * 5/1996 Abraham, II ..... A42B 3/0473 2/205
6,182,300 B1 2/2001 Severance
6,253,389 B1 * 7/2001 Scaglione ..... A41D 13/0518 2/421
6,874,170 B1 4/2005 Aaron
7,340,804 B2 * 3/2008 Saderholm ..... A44B 11/06 2/426
7,867,181 B2 * 1/2011 Powell ..... A61F 5/055 5/622
8,621,672 B2 * 1/2014 Chuback ..... A41D 13/0512 2/421
8,905,958 B2 * 12/2014 Senyei ..... A61F 5/055 602/18
9,462,841 B1 * 10/2016 Popejoy ..... A63B 71/081
10,226,383 B2 * 3/2019 Ambring ..... A61F 9/06
2012/0291183 A1 11/2012 Janisse et al.

* cited by examiner

*Primary Examiner* — Khoa D Huynh
*Assistant Examiner* — Grace Huang
(74) *Attorney, Agent, or Firm* — Glenn E. Gold, P.A.; Glenn E. Gold

(57) ABSTRACT

An anti-concussion helmet attachment collar assembly includes a cowl body attached to a curved helmet attachment ring segment at its upper end, and to a cowl support ring at its lower end. A circular rolling element bearing is interposed between the bottom of the cowl support ring and the interior shoulder of an underlying central ring, facilitating rotation of the cowl support ring with respect to the central ring. A modified helmet incorporates a flange with keyhole openings coupleable with standoff rivets on the helmet attachment ring segment. A base attached to equipment, such as football shoulder pads, is configured to selectively couple with the central ring during use.

13 Claims, 8 Drawing Sheets

ANTI-CONCUSSION COLLAR ASSEMBLY AND METHOD OF USE

FIELD OF THE INVENTION

The present invention relates generally to apparatuses for preventing concussions. More particularly, the present invention is concerned with apparatuses for preventing concussions to an individual while donning a protective helmet during a sporting activity.

BACKGROUND OF THE INVENTION

Concussions are a common occurrence in sports. High school and professional athletes suffer thousands of concussion every year; particularly in American football and ice hockey. Concussions do not always involve being "knocked out," or a loss of consciousness. A concussion occurs when an individual's mental status changes as a result of trauma (usually a blow to the head). Sports-related concussions often result in mental and physical symptoms (e.g., inability to concentrate, forgetfulness, headache, fatigue; dizziness, etc.). For many athletes, the symptoms disappear after about 10 days, and they typically do not last more than several months. In some cases, though, concussions lead to persistent complaints of physical, mental, emotional, and behavioral symptoms, sometimes referred to as post-concussion syndrome. In some cases, when repeated concussions occur over a brief interval, athletes may suffer from secondary impact syndrome, a pathological response of the brain that can be life-threatening if not treated promptly.

During the past decade or so the issue of concussions in sports has garnered worldwide attention. In particular; publicity relating to sports-related concussions and the severe long-term health impact of concussions has exploded. It has long been known that concussions can lead to permanent loss of higher level mental processes. Scientists have debated for centuries whether concussions involve structural damage to brain tissue, or whether physiological changes that merely impair the way brain cells function explain this loss. More recently; researchers have linked areas of brain injury to specific altered mental processes caused by concussions.

As a result, there has been a concerted effort throughout the sports industry to develop equipment to better protect athletes from suffering concussions while playing sports—particularly, football. In fact; the National Football League (NFL) has recently announced that it will spend upwards of $100 million to advance concussion research, with a significant portion of that money going toward continuing efforts to develop a safer helmet. Unfortunately, doctors have said, so far, helmets have done little to reduce concussions and the long-term effects of repeated head trauma. In its earliest days, the purpose of the football helmet was to prevent the sport's scariest; most visible injuries; grisly skull fractures and broken necks. Today's safety standards for helmets were developed in response to high number of fatalities in 1968, when 36 players were killed across all levels of the sport. But, in recent years; a growing body of evidence has shown that these helmets still aren't nearly enough to prevent dangerous head injuries. The concussion-proof helmet has become the holy grail of helmet design. But, researchers are beginning to wonder whether such a thing really exists.

A concussion can happen without actually hitting your head. If you can get a concussion without actually hitting your head, then a helmet can't possibly prevent every concussion that can happen. In fact, over the past couple of decades there has been a proliferation of inventions specifically focused on finding a particular helmet design that will adequately prevent the high occurrence of sports-related concussions. Unfortunately, for the most part, the focus of such research into new concussion-eliminating helmet designs has been of little or no avail. Primarily, this is due to the fact that concussions are not simply caused by, for example, head-to-head or head-to-ground impact. Concussions occur as the result of any impact that causes the head and brain to move rapidly back and forth in a whiplash-like fashion. The sudden movement causes the brain to bounce or twist around inside the skull, stretching and damaging the delicate cells and structures inside of the brain.

Accordingly, what is needed is a means of reducing such whiplash-like movement—not just a reconfigured helmet design that better absorbs the impact of a sudden blow to the head. It would be highly-desirable to provide some type of mechanism that could be employed, in conjunction with, for example, an impact-dampening helmet design, which would function to further minimize the primary cause of sports concussions (i.e. whiplash-type movement of the head) and which could be easily integrated with a conventional helmet design, or a slightly-modified helmet design, while limiting additional physical constraints on an athlete during play (e.g. without impeding the ability of a player to rotate his or her head). That is, a mechanism that could be employed by, for example, a football player; but would not introduce new physical limitations significantly impeding the player's ability to perform.

SUMMARY OF THE INVENTION

The present invention is directed to an anti-concussion collar assembly adapted for use with a slightly modified sports helmet.

In accordance with an exemplary implementation, an anti-concussion helmet attachment collar assembly may include:

(a) a cowl and cowl ring subassembly, including:

(1) a cowl body extending from a cowl body upper end portion to a cowl body lower end portion;

(2) a rigid curved helmet attachment ring segment having at least one helmet attachment coupling mechanism along an upper surface thereof, the cowl body upper end portion fixedly attached to the helmet attachment ring segment; and (3) an annular-shaped rigid cowl support ring at least partially defined by an upper side; a lower side, an interior side; and an exterior side, the interior side defining a cowl support ring central opening, the upper side and the exterior side adjoined by a stepped portion defining a peripheral cowl support ring shoulder; the cowl body lower end portion fixedly attached to the annular-shaped rigid cowl support ring;

(b) an annular-shaped rigid central ring at least partially defined by a peripheral wall having an upper side, a lower side, an exterior side adjoining the upper and lower peripheral wall sides, an interior side having a shoulder extending radially inward therefrom and terminating at an interior shoulder edge, the interior should edge defining a central ring opening, and a continuous circular channel extending into the peripheral wall interior side between the shoulder and the peripheral wall upper side; the exterior side of the central ring peripheral wall having at least one coupling feature integrated therewith;

(c) a circular rolling element bearing including a series of spherical balls positionally-secured with respect to one another within a race in a manner enabling rotation of each of the spherical balls within the race, the rolling element bearing interposed between the lower side of the cowl support ring and an upper surface of the central ring shoulder; and (d) a base having a generally annular geometry at least partially defined by a circular peripheral sidewall having an interior surface, an exterior surface, an upper surface, a lower surface, and a shoulder extending radially inward from the peripheral sidewall interior surface and terminating at a shoulder edge defining an annular base central opening, the circular peripheral sidewall having at least one coupling structure provided therein, the at least one coupling structure sized, shaped and otherwise configured for selective fixed coupling with the at least one coupling feature integrated with the peripheral exterior side of the central ring in a manner preventing any movement of the central ring vis-à-vis the base.

In an aspect, the anti-concussion collar assembly may include a modified sports helmet having an integral peripheral flange extending partially about a lower helmet edge, the flange having at least one coupling feature provided therein and configured for selective, releasable coupling engagement with the at least one helmet attachment coupling mechanism integrated with the rigid curved helmet curved attachment ring segment along the upper surface thereof.

In another aspect, the helmet attachment coupling mechanism(s) that are integrated along the upper surface of the rigid curved helmet attachment ring segment may be in the form of a rivet-type member, coupleable with a corresponding keyhole aperture in a flange along the lower edge of a modified helmet.

In another aspect, the cowl support ring peripheral shoulder may be configured to facilitate seating within the continuous circular channel extending into the peripheral wall interior side of the rigid central ring between the shoulder and the peripheral wall upper side thereof.

In another aspect, a circular groove may be provided in the lower side of the annular-shaped rigid cowl support ring, a circular groove provided in the upper surface of the central ring shoulder, and the spherical balls of the circular rolling element bearing contained therebetween to facilitate rotation of the cowl support ring with respect to the central ring and the base; thereby, supporting a natural neck-turning motion of a player.

In another aspect, stop limit features and stop mechanisms may be provided on the cowl support ring and the surrounding central ring in order to limit rotation of the helmet support ring and, thereby, prevent over-rotation of a player's head (e.g. where a helmet facemask is grabbed by another player).

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which.

Like reference numerals refer to like parts throughout the several views of the drawings.

Detailed Description of Exemplary Implementations

Figure 1:
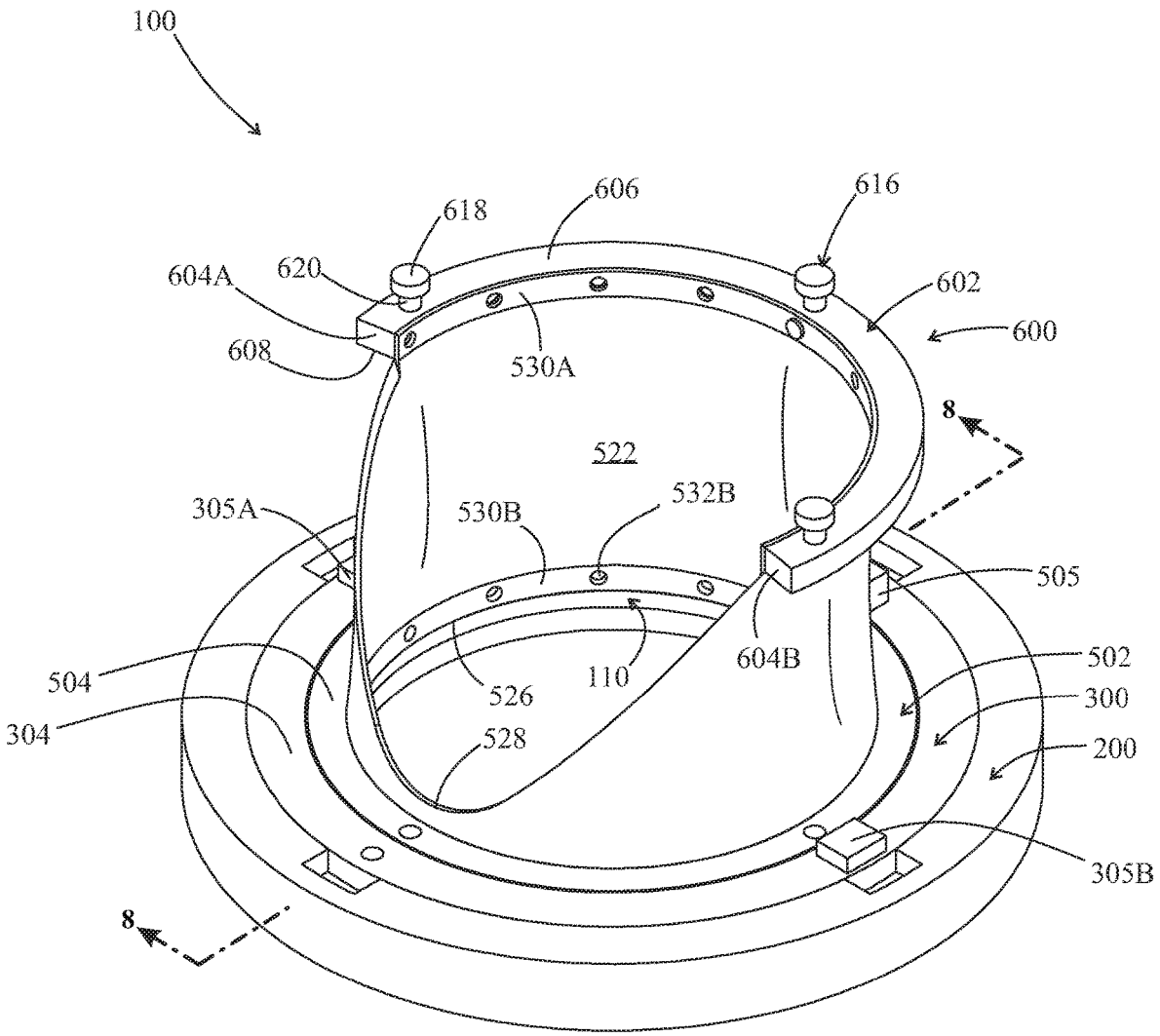
FIG. 1 presents a top right perspective view of a fully assembled anti-concussion collar assembly in accordance with an exemplary embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. The implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise. Furthermore, in the description that follows, like parts are marked throughout the specification and drawings with the same reference numerals respectively. The drawing figures are not necessarily to scale and in certain views proportions may have been exaggerated for purposes of clarity.

Referring now to FIGS. 1-8, the present invention provides an anti-concussion collar assembly, shown generally as reference numeral 100, which broadly includes: (a) a cowl and cowl-supporting ring subassembly 500 (FIG. 2) having a curved helmet attachment ring portion 600, including a curved ring body 602, or segment, fixedly secured to an upper portion thereof; (b) a central ring, shown generally as reference numeral 300; (c) a rolling element bearing mechanism, shown generally as reference numeral 400, interposed between cowl ring 502 of cowl and cowl-supporting ring subassembly 500, and central ring 300; (d) a base member, shown generally as reference numeral 200, which may be releasably-attached to or, alternatively, directly integrated with, underlying sports equipment gear conventionally donned by an individual athlete while participating in a respective sports-related competition; such as the exemplary football shoulder pad subassembly 160 shown in FIG. 5. As will be apparent to those skilled in the sports equipment arts, the base 200 of the collar assembly 100 has a flexible configuration and design that is highly adaptable for use with any of a variety of different types of underlying sports equipment gear including, by way of example and not limitation, football shoulder pads 160 (as shown in the representative example shown in FIGS. 5-7), a fire suit donned by a race car driver (not shown), and the like. In this manner, the base member 200 enables indirect, selective releasable attachment of the central ring 300 to underlying sports equipment gear to subsequently enable and facilitate releasable attachment of the anti-concussion collar assembly 100, with or without a helmet 150 (FIGS. 5-7) attached thereto; to the underlying sports equipment gear.

Figure 2:
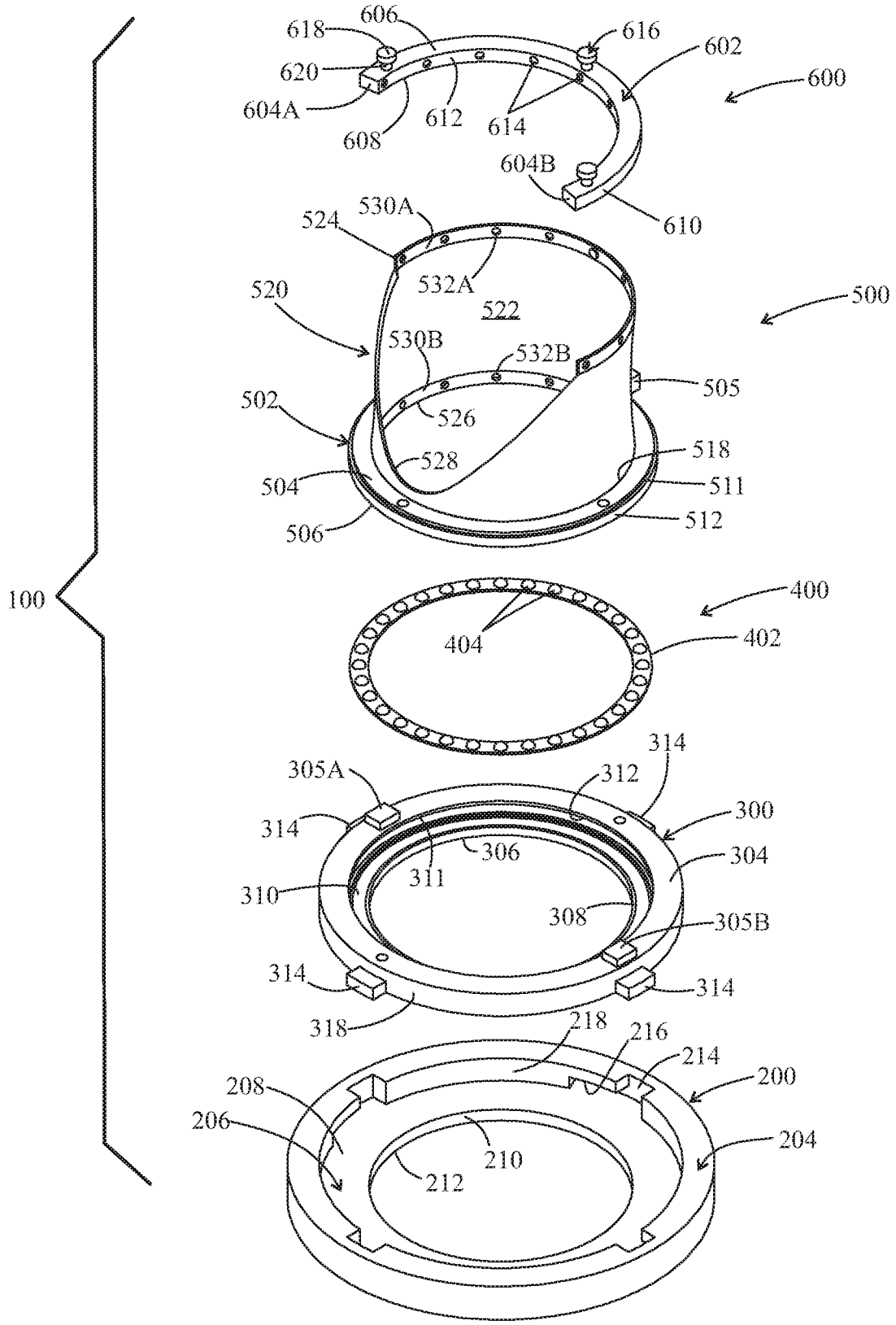
FIG. 2 presents a top right exploded perspective view of an anti-concussion collar assembly in accordance with an exemplary implementation of the present invention.
Figure 4:
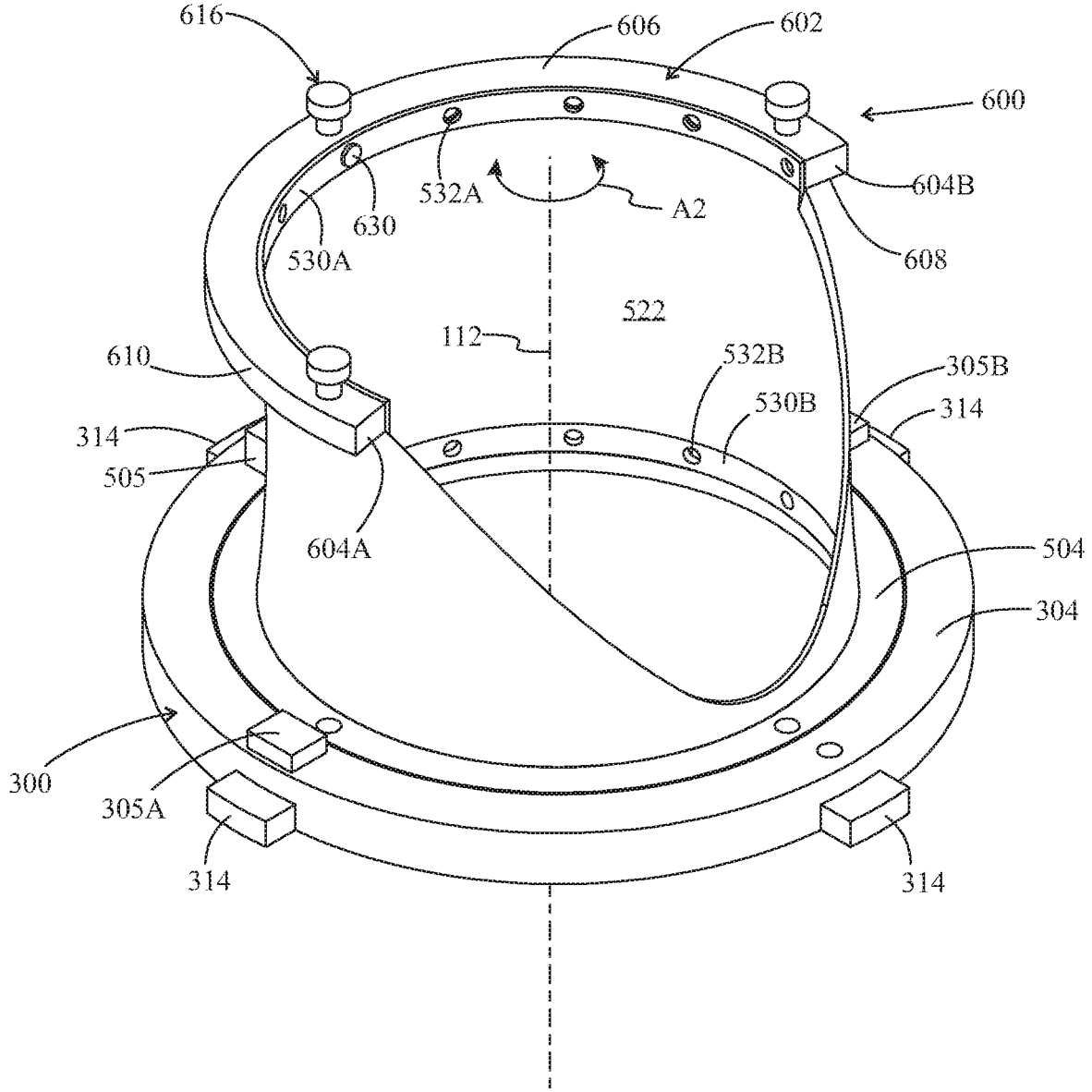
FIG. 4 presents a top left perspective view of the anti-concussion collar assembly 100 of the present invention, shown isolated (i.e. separated and detached) from base 200.

As best shown in FIGS. 1, 2, and 4, cowl and cowl ring subassembly 500 further includes a cowl subassembly 520 having a curved ring attachment portion 600 fixedly attached to a cowl upper end 524. Cowl subassembly 520 further includes a helmet-coupling rigid, curved ring segment 602 extending from a left end 604A to a right end 604B, and further defined by an upper surface 606; or topside; a lower surface 608, or underside, an exterior surface 610, or exterior side, an interior surface 612, or interior side, and a plurality of spaced-apart apertures 614 extending into the interior surface for receiving corresponding fastener components 630 (FIG. 4). Significantly, as described in greater detail hereinbelow, ring segment 602 is particularly designed to facilitate the donning, and subsequent removal, of a protective helmet 150 by an athlete while participating in a sport. For that purpose, significantly, the ring segment 602 incorporates structure for enabling and facilitating selective, releasable coupling to a helmet. In the representative exemplary implementation shown in the accompanying drawing figures, this is accomplished via the incorporation of a plurality of spaced-apart standoff rivets 616 extending vertically upwards from upper surface 606, wherein each rivet includes a standoff rivet body 620 terminating distally at a standoff rivet head 618.

Cowl and cowl ring subassembly 500 may include a flexible, deformable cowl 522 fixedly attached proximate cowl lower edge 526 to annular cowl support ring 502. Initially, it should be noted that, for the purpose of clarity, the height of the cowl represented in the drawing figures is greatly exaggerated (i.e. not shown reflecting an accurate height in proportion to the rest of the structure of collar assembly 100). Although the invention is not intended to be limiting vis-à-vis the height of the cowl body 522, preferably, cowl body 522 has a height, shown as distance $d_1$ (FIG. 6), actually falling within a range of about 1.0 cm to about 5.0 cm. Cowl body 522 preferably includes a cutout portion 528 to expose the wearer's face and/or neck region. A cowl body upper end strengthening member 530A and cowl body lower end strengthening member 530B, for example, in the form of reinforced leather, tear-resistant fabric, or any other suitable reinforcing material, are provided affixed about the corresponding upper and lower portions of the cowl. A series of spaced-apart upper cowl apertures 532A may be provided extending completely through corresponding cowl strengthening member 530A (and the underlying cowl body 522) aligned with corresponding apertures 614 extending through the interior surface 612 of rigid curved helmet attachment ring segment 602. Likewise, a series of spaced-apart lower cowl apertures 532B may be provided extending completely through corresponding cowl strengthening member 530B (and the underlying cowl body 522) aligned with corresponding apertures (not shown) extending into the interior surface 518 (FIG. 2) of cowl support ring 502. Fasteners 630 (FIG. 4) are provided for receipt through the upper cowl strengthening member apertures 532A (and underlying aligned apertures through cowl body 522) and corresponding apertures 614 in the underlying helmet attachment curved ring segment body 602 for fixedly attaching the upper end portion of the cowl body 522 thereto. In similar fashion, fasteners 630 are provided for receipt through apertures 532B in lower strengthening member 530B (and apertures through the underlying cowl body 522) and corresponding apertures (not shown) in the underlying interior surface of cowl support ring 502. Cowl annular-shaped support ring 502 is further defined by upper surface 504, having cowl support ring stop feature 505 protruding upwardly, and extending distally outward, therefrom; lower surface 506; exterior peripheral edge 512; shoulder 511 defined by an inwardly-stepped upper portion of the exterior peripheral edge; and interior surface 518.

A unitary central ring 300 having a generally annular geometry is defined by upper central ring surface 304 having a pair of spaced-apart left and right central ring rotation stop limit features, 305A and 305B, respectively, extending upwardly therefrom; lower central ring surface 306; interior peripheral sidewall surface 311 having a peripheral groove 312 provided therein; exterior peripheral sidewall surface 318; spaced-apart tabs 314 protruding outwardly from exterior peripheral sidewall surface 318; and interior peripheral shoulder 308 having concave upper surface 310.

Significantly, as best shown in FIG. 2, collar assembly 100 incorporates a circular rolling element hearing, shown generally as reference numeral 400; interposed between lower surface 506 of cowl support ring 502, and shoulder 308 of central ring 300. In the exemplary implementation shown in FIGS. 2 and 8, the circular rolling element 400 is depicted as a ball bearing including a series of spherical balls 404 maintained within a race 402. Furthermore, the ball bearing 402, 404 is shown maintained within an upper groove 506A (FIG. 8) in the lower surface 506 of cowl support ring 502, and a lower groove 310A (FIG. 8) in the upper surface 310 of shoulder 308 of central ring 300. This particular configuration is commonly referred to as a thrust bearing. However, the invention is not intended to be so limiting. To the contrary, applicant contemplates incorporating any of myriad known types of circular rolling element bearings providing substantially free-spinning rotation of cowl subassembly 500 within central ring 300 (albeit, limited by rotational engagement of cowl support ring stop feature 505 with left and right central ring rotation stop limit feature, 305A and 305B, respectively, while the central ring is secured to base 200. In this manner; the rolling element bearing 400 enables substantially friction-free rotation of a user's helmet-protected head within maximum degree of rotation limits defined, or established, by rotation-limiting features referenced briefly above and described in further detail hereinbelow, and depicted in the accompanying drawing figures, while employing the anti-concussion collar assembly 100 of the present invention.

A unitary base member body, represented generally by reference numeral 200, having a generally annular geometry, may be provided either integrated directly with or, alternatively, releasably-attachable to, underlying sports equipment, such as the shoulder pads 160 (FIG. 7) shown in the exemplary football-related implementation of the present invention. Base 200 is generally defined by a thickened circular peripheral sidewall 204. A shoulder 206 is provided extending inwardly from interior surface 218 of peripheral sidewall 204, and defines a central opening 210. Shoulder 206 is further defined by an upper surface 208 and a lower surface 212. Although not shown in the accompanying drawing figures, the lower surface 212 may have a selective coupling structure similar to the standoff rivets 616 used to couple helmet attachment curved ring segment 602 to flange 152 of helmet 150 (FIGS. 5 and 5A), the functionality of which is described in further detail hereinbelow. In that case, the underlying base support equipment 160 (e.g. football shoulder pads) would incorporate a corresponding engagement structure for facilitating coupling of the base 200 to the underlying base support equipment 160. Circular peripheral sidewall 204 may be provided having a series of spaced-apart notches 214 extending into interior surface 218, each notch contiguous with an undercut 216. During assembly, spaced-apart tabs 314 of central ring 300 are received through corresponding base notches 214, and central ring 200 is subsequently rotated, in this case counter-clockwise, to create a secure friction fit attachment of central ring 300 to base 200.

Figure 5:
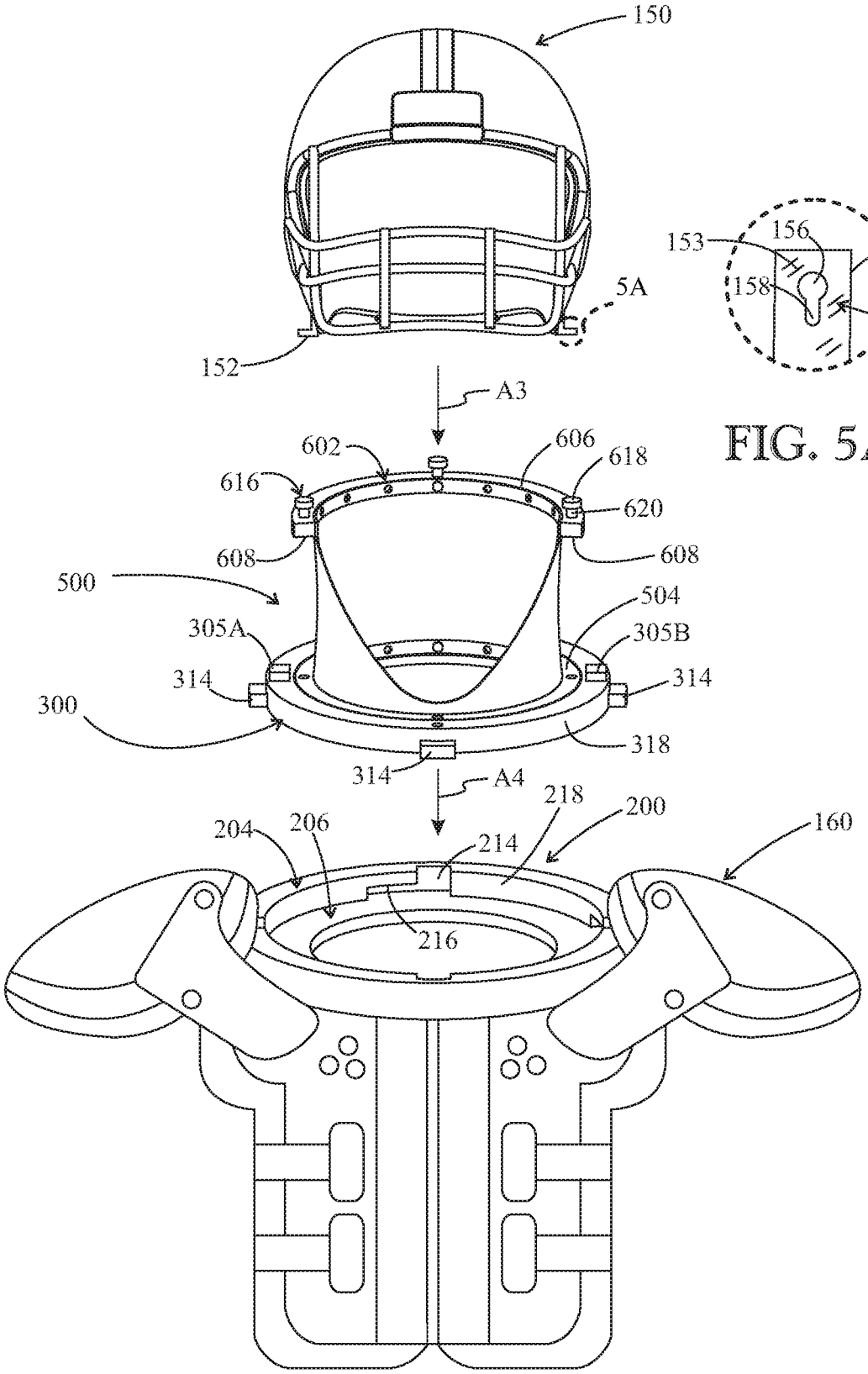
FIG. 5 presents a top front partially-exploded view of the anti-concussion collar assembly 100 of the present invention, shown partially assembled, with: (a) base 200 fixedly attached to (i.e. integrated with) an exemplary shoulder pad protection assembly; (b) a corresponding modified helmet 150 incorporating a helmet flange 152; and (c) an assembled helmet attachment portion 600, cowl and cowl ring subassembly 500; rolling element bearing 400, and central ring 300 interposed therebetween.
Figure 5A:
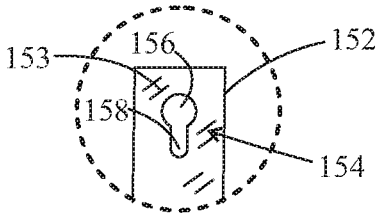
FIG. 5A presents an enlarged, magnified plan view of an underside 153, or bottom surface, of flange 152 of helmet 150, better illustrating keyhole slot 154 used to couple the helmet flange to rigid curved helmet attachment ring segment 602 via standoff rivets 616.

Referring now briefly to FIGS. 5 and 5A, in the exemplary implementation of the present invention, a slightly modified helmet 150 is provided having a lower helmet partial peripheral flange 152 incorporating a series of spaced-apart keyhole slots 154 extending completely therethrough corresponding to, and aligned with, the standoff rivets 616 of ring segment 602. Referring particularly to FIG. 5A, a keyhole slot, shown generally as reference numeral 154, is provided extending completely through flange 152. The keyhole slot 154 is defined by a narrowed portion 158 extending from an enlarged portion 156. The narrowed portion 158 of the keyhole slot 154 is generally an elongated oval configuration that is sized to allow body 620 of standoff rivet 616 to slide therealong to a closed end, but not allow the head 618 of the standoff rivet to pass therethrough. While the elongated oval configuration of the narrowed portion may have parallel sides, alternatively, the sides may have a slight inward taper in the direction of the closed circular end (i.e. the end opposite enlarged end 156). This is a significant feature of the present invention, as it enables an individual user to easily attach and/or remove helmet 150 during a sports competition (e.g. to facilitate an expeditious exchange of helmets).

As best shown in FIG. 5, the cowl and cowl ring subassembly 500, attached helmet-attachment curved ring segment 602, central ring 300, and rolling element bearing 400 (FIG. 2) interposed therebetween, are lowered, as depicted by directional arrow A4, and coupled to base 200 via insertion of central ring tabs 314 into corresponding base notches 214, and subsequent rotation of the ring tabs into undercuts 216, as described in more detail below. Subsequently, with central ring 300 fixedly coupled to base 200, helmet 150 may be lowered as depicted by directional arrow A3, and selectively coupled to curved ring segment 602 as previously described. As shown in FIG. 5, following secure rotational attachment of the cowl and cowl ring subassembly 500 (including attached curved helmet attachment portion 600), rolling element bearing 400, and central ring 300 to base member 200 (following insertion of central ring tabs 314 into receiving base notches 214, as indicated by directional arrow $A_4$), helmet 150 may be selectively releasably attached, via rotational engagement, and counter-rotational disengagement, of keyhole slots 154 in flange 152 with standoff rivets 616 in upper surface 606 of curved ring segment 602, to facilitate the donning of helmet 150 upon the head of a player (depicted by phantom line 170 in FIG. 7), and subsequent removal of the helmet.

More specifically, during attachment, helmet 150 is lowered (as indicated by directional arrow A3) such that lower surface 153 of flange 152 is moved toward upper surface 606 of ring segment 602, with the center of enlarged portion 156 of keyhole slot 154 generally aligned with the head 618 of standoff rivet 616. Once the head 618 of standoff rivet 616 is received completely through enlarged portion 156 of keyhole slot 154 the helmet 150 is slightly rotated (e.g. in this case in a clockwise rotational direction) until standoff rivet body 620 is snugly frictionally secured within narrowed portion 158 of the keyhole slot. In opposite fashion, during removal, helmet 150 is counter-rotated (e.g. in this case in a counter-clockwise rotational direction) until standoff rivet body 620 and corresponding rivet head 618 are centrally aligned with the center of enlarged portion 156 of keyhole slot 154, and helmet 150 is raised in a direction opposite that depicted by directional arrow $A_3$.

Figure 3:
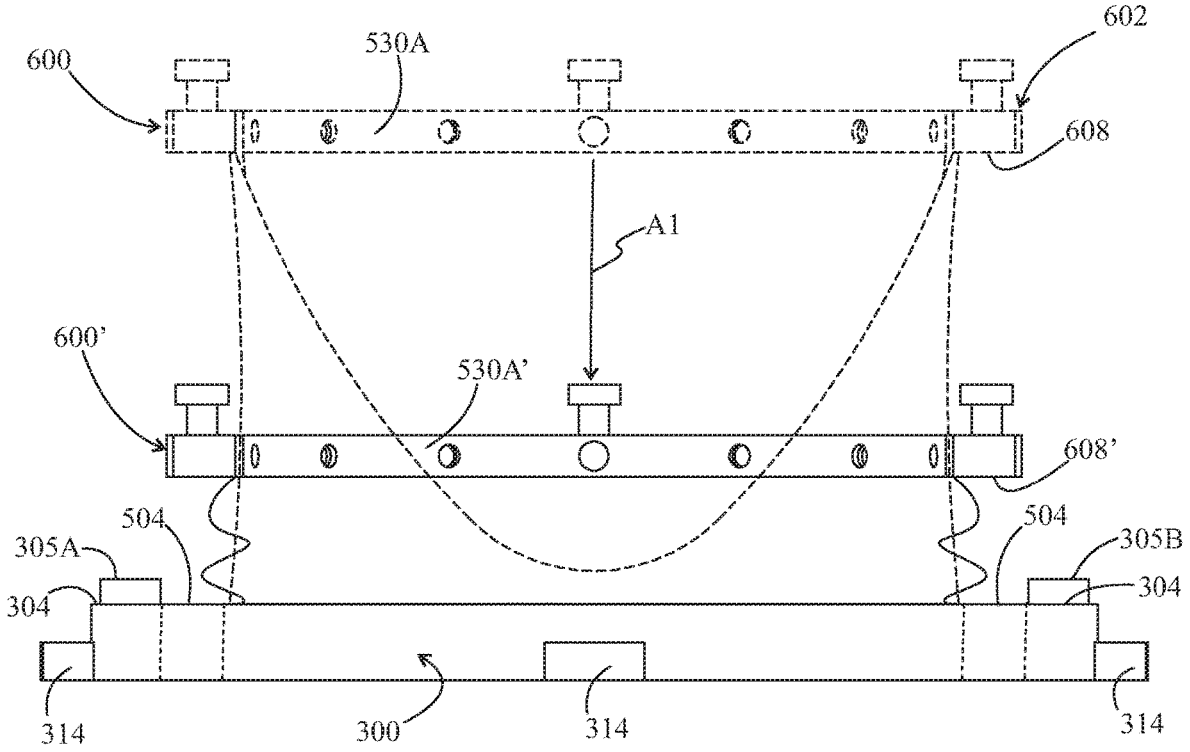
FIG. 3 presents an elevated front plan view of the cowl and cowl support ring subassembly 500; and the helmet attachment curved ring portion 600, of the anti-concussion collar assembly shown in FIG. 1, illustrating the vertical translation of the helmet attachment curved ring portion 600 from a fully-extended position to a partially compressed (in the direction represented by arrow A1) position 600'.
Figure 6:
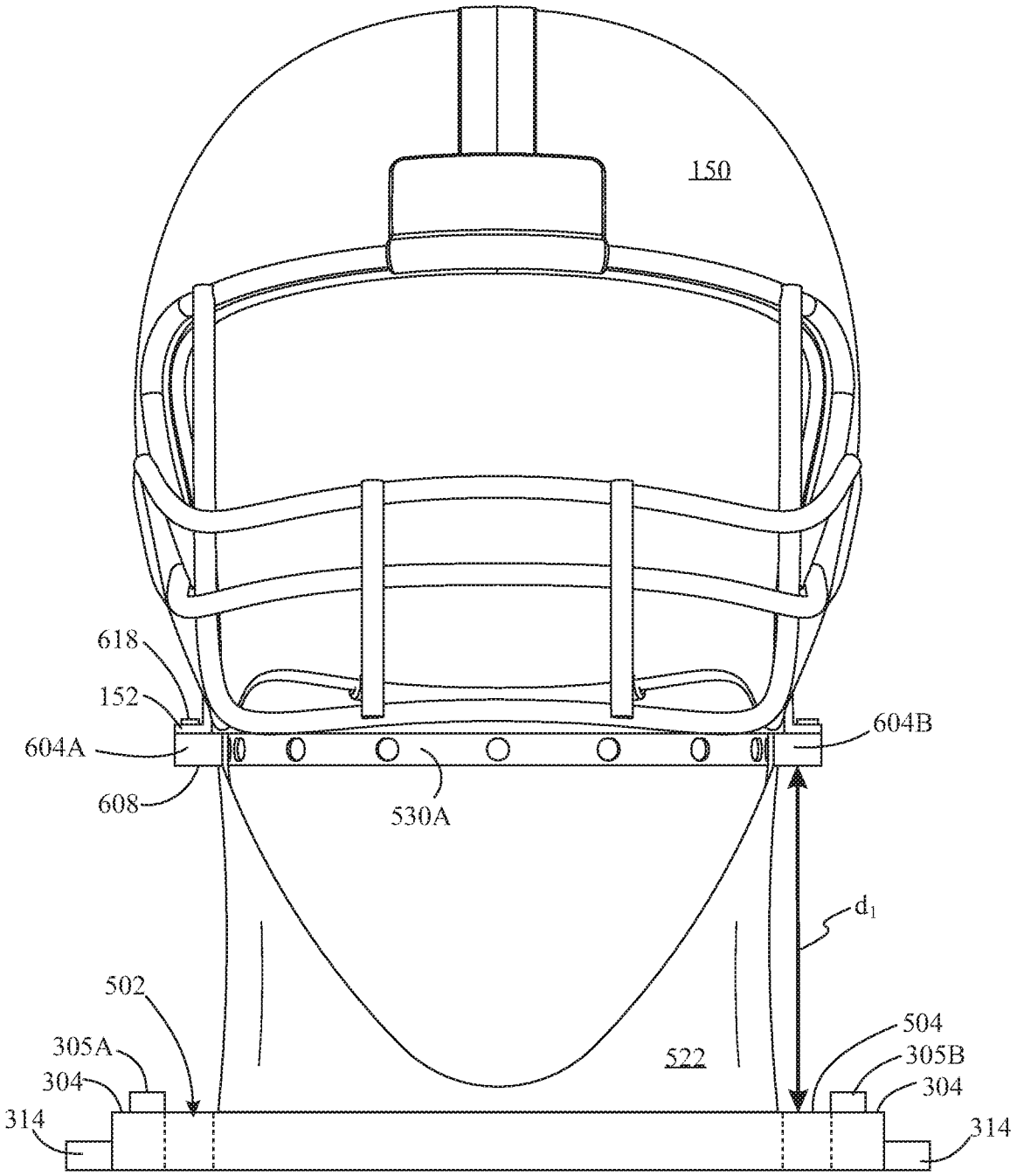
FIG. 6 presents the anti-concussion collar assembly 100 shown in FIG. 5 (absent base 200 and base support equipment 160), depicted in a fully-assembled state.
Figure 7:
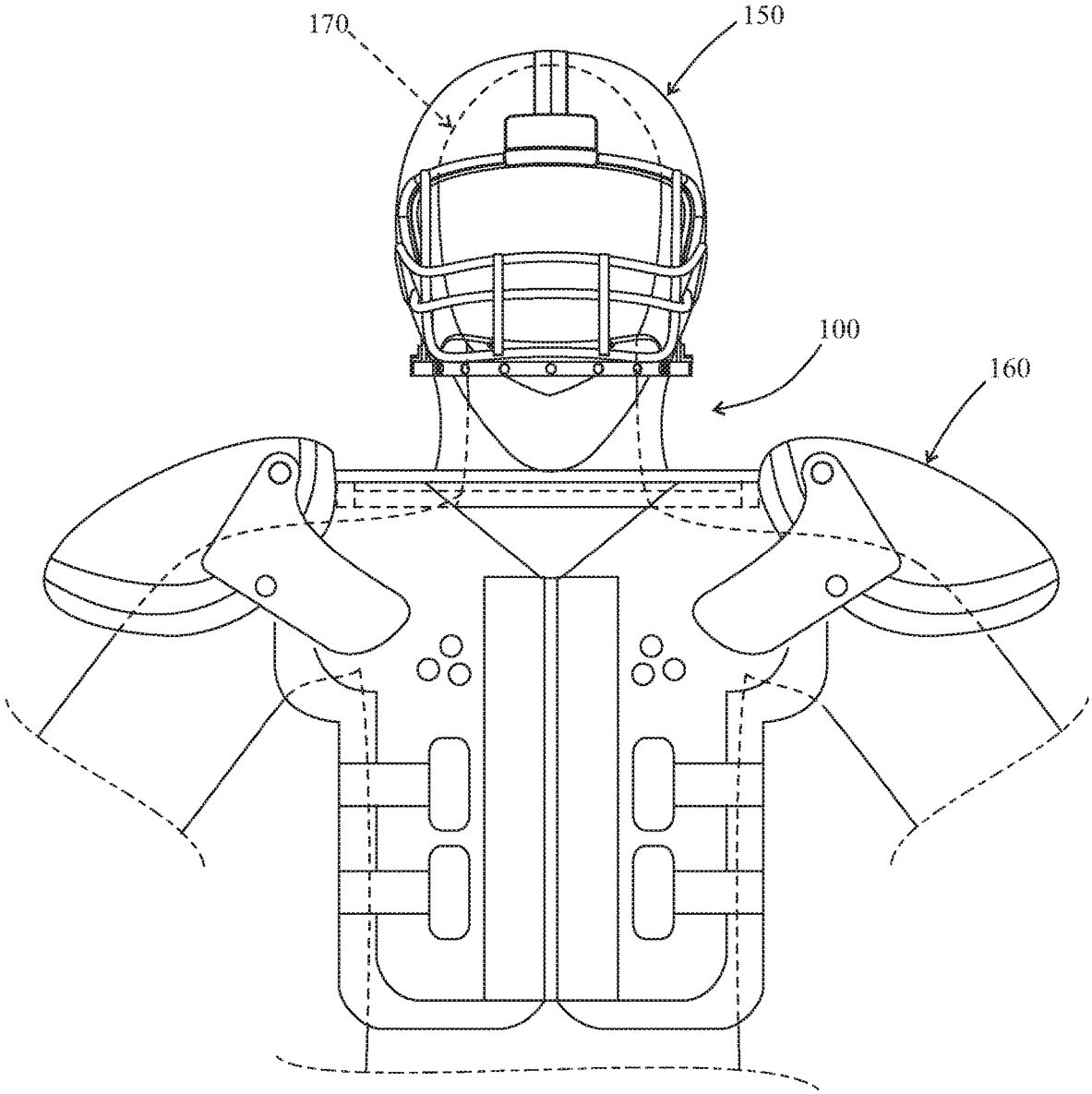
FIG. 7 presents a front elevation view the anti-concussion collar assembly 100 shown in FIG. 5 in a fully-assembled state, and further depicting the upper body of a user 170 (represented in phantom view) donning the assembly.

Referring briefly to FIG. 3, the vertical translation of the helmet attachment curved ring portion from a fully-extended position 600 to a partially compressed (in the direction represented by arrow $A_i$) position 600' is shown. Referring now particularly to FIG. 6, significantly, while being worn in a fully assembled state, compression of the head and neck of a wearer (e.g. upon direct impact with another player helmet, a ground surface, etc.) is limited to the distance ($d_i$) between the lower surface 608 of the helmet-supporting ring segment 600, by direct engagement of the lower surface 608 against the upper surface 504 of cowl support ring 502. As previously stated hereinabove, the distance ($d_i$) between the lower surface 608 of the helmet-supporting ring segment 602 and the upper surface 504 of the cowl support ring 502 is greatly exaggerated in the accompanying figures simply for the purpose of clarity. This feature of the present invention provides an important safety function. That is, by indirectly limiting downward compression of the helmet, compression of a user's neck and spine, and related anatomical structure, is correspondingly limited to effectively prevent compression-related injuries to the individual employing the anti-concussion collar assembly 100.

Referring primarily to FIGS. 1, 2, and 4, during use, cowl support ring stop feature 505, or stop mechanism, limits rotation of cowl support ring 502, in both clockwise and counterclockwise directions (as indicated by axial rotation arrow $A_2$ about central axis 112), via contact engagement with respective central ring rotational stop limit features 305A and 305B. This is a further significant feature of the present invention in that this feature further minimizes, or limits, the likelihood of incurring a concussion, or other head and neck related injury, by a player through restricted rotation of the player's helmet-covered head within a safe, injury-limiting, rotational range. Although the stop limit features 305A, 305B are shown spaced 180-degrees apart from one another in the accompanying drawing figures, the invention is not intended to be so limiting. To the contrary, applicant contemplates incorporating stop limit features having any desired angular separation. For instance, it may be desired to provide a reduced angular rotational range when the invention is implemented in youth sports. Furthermore, in lieu of such external mechanical stop limit features applicant contemplates incorporating of any of a number of alternative rotation-restricting mechanisms of cowl ring 502. Referring briefly particularly to FIG. 4, in a hilly-assembled state rigid curved helmet attachment ring segment 602, cowl ring 502, and central ring 300 are preferably all concentric about a common longitudinal central axis 112. Furthermore, base member 200 (not shown in FIG. 4) is also preferably concentric about longitudinal central axis 112 with the entire collar assembly 100 in a fully-assembled state.

Figure 8:
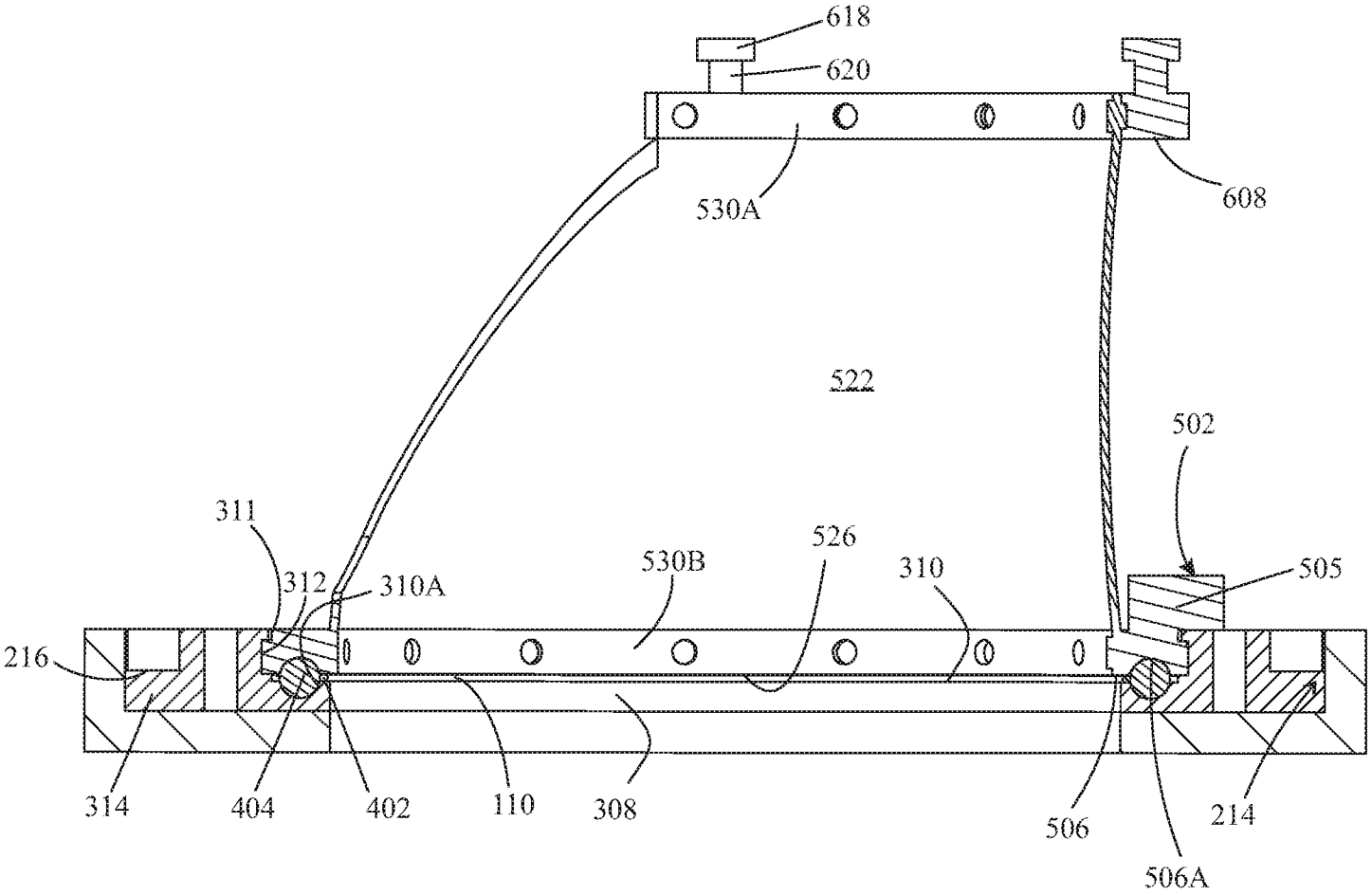
FIG. 8 presents a cross-sectional view taken along section line 8-8 of FIG. 1.

Referring briefly to FIG. 8, in a fully-assembled state it can be seen that spherical balls 404 of rolling element bearing 400 are seated, or contained, within a channel defined between lower groove 310A in the upper surface 310 of central ring shoulder 308, and upper groove 506A in the lower surface 506 of cowl support ring 502, leaving a nominal space 110, or gap, between lower edge 526 of cowl 522, and the upper surface 310 of central ring shoulder 308. Significantly, the structure provides for substantially friction-free rotation of the cowl and cowl ring subassembly 500, along with rigid curved helmet attachment ring segment 602 and attached helmet 150. Consequently, the novel structural design incorporates a unique approach that not only affords a vast improvement vis-à-vis helmet-focused approaches for reducing the likelihood of a player suffering a concussion during a sporting competition, but accomplishes this without introducing significant head and neck movement-restricting impediments that could otherwise negatively impact player performance.

The above-described embodiments are merely exemplary illustrations of implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims.

What is claimed is:

1. An anti-concussion collar assembly, comprising:

a cowl and cowl ring subassembly, comprising:

a cowl body extending from a cowl body upper end to a cowl body lower edge;

a rigid curved helmet attachment ring segment having at least one helmet attachment coupling mechanism along an upper surface thereof, the cowl body upper end fixedly attached to the rigid curved helmet attachment ring segment; and an annular-shaped rigid cowl support ring at least partially defined by an upper side, a lower side, an interior side, and an exterior side, the interior side defining a cowl support ring central opening; the upper side and the exterior side adjoined by a stepped portion defining a peripheral cowl support ring shoulder, the cowl body lower edge fixedly attached to the annular-shaped rigid cowl support ring;

an annular-shaped rigid central ring at least partially defined by a peripheral wall having an upper side, a lower side, an exterior side adjoining the upper and lower peripheral wall sides, an interior side having a shoulder extending radially inward therefrom and terminating at an interior shoulder edge, the interior shoulder edge defining a central ring opening, and a continuous circular groove extending into the peripheral wall interior side between the shoulder and the peripheral wall upper side; the exterior side of the central ring peripheral wall having at least one coupling feature integrated therewith;

a circular rolling element bearing including a series of spherical balls positionally-secured with respect to one another within a race in a manner enabling rotation of each of said spherical balls within the race, the rolling element bearing interposed between the lower side of the cowl support ring and an upper surface of the central ring shoulder; and a base having a generally annular geometry at least partially defined by a circular peripheral sidewall having an interior surface, an exterior surface, an upper surface, a lower surface, and a shoulder extending radially inward from the peripheral sidewall interior surface and terminating at a shoulder edge defining an annular base central opening, the circular peripheral sidewall having at least one coupling structure provided therein, the at least one coupling structure sized, shaped and otherwise configured for selective fixed coupling with the at least one coupling feature integrated with the peripheral exterior side of the central ring in a manner preventing any movement of the central ring vis-à-vis the base.

2. The anti-concussion collar assembly as recited in claim 1, further comprising a modified sports helmet having an integral peripheral flange extending partially about a lower helmet edge, the flange having at least one coupling feature provided therein and configured for selective, releasable coupling engagement with said at least one helmet attachment coupling mechanism integrated with the rigid curved helmet attachment ring segment along the upper surface thereof.

3. The anti-concussion collar assembly as recited in claim 2, said at least one helmet attachment coupling mechanism integrated with the rigid curved helmet attachment ring segment along the upper surface thereof further comprising:

a rivet-shaped member having a body portion extending upwardly from a topside of the peripheral wall and terminating at an enlarged head portion.

4. The anti-concussion collar assembly as recited in claim 3, said at least one coupling feature provided in the flange further comprising:

at least one keyhole slot extending completely through said flange, the at least one keyhole slot defined by an enlarged circular portion contiguous with a narrowed portion extending therefrom, the enlarged circular portion sized to enable receipt of the enlarged head portion of the rivet-shaped member, and the body portion sized for enabling snug frictional sliding of the body portion of the rivet-shaped member toward a closed end of the narrowed portion of the at least one keyhole slot.

5. The anti-concussion collar assembly as recited in claim 1, said cowl support ring peripheral shoulder sized, shaped and otherwise configured for receipt within the continuous circular groove extending into the peripheral wall interior side of the rigid central ring between the shoulder and the peripheral wall upper side thereof.

6. The anti-concussion collar assembly as recited in claim 5, further comprising:

a circular groove provided in the lower side of the annular-shaped rigid cowl support ring:

a circular groove provided in the upper surface of the central ring shoulder; and said spherical balls of the circular rolling element beating contained between said cowl support ring circular groove and said central ring shoulder groove, thereby facilitating rotation of the cowl support ring with respect to the central ring and the base.

7. The anti-concussion collar assembly as recited in claim 1, further comprising:

at least one stop feature extending radially outward from the upper side of said cowl support ring and terminating at a position beyond the cowl support ring exterior side; and at least one raised stop limit feature extending upwards from the upper side of said annular-shaped rigid central ring;

said at least one central ring upper side stop limit feature functioning to limit rotation of the cowl support ring vis-à-vis the central ring.

8. The anti-concussion collar assembly as recited in claim 7, wherein said at least one central ring upper side stop limit feature further comprises a pair of angularly spaced-apart stop limit features.

9. The anti-concussion collar assembly as recited in claim 1, wherein said at least one coupling feature integrated with the exterior side of the central ring peripheral wall further comprises:

at least one tab extending radially outward from the exterior side of the peripheral wall of said annular-shaped rigid central ring.

10. The anti-concussion collar assembly as recited in claim 9, wherein said at least one coupling structure provided in the circular peripheral sidewall of said base further comprises:

at least one notch extending into the upper surface and the interior surface of the peripheral sidewall; and at least one undercut contiguous with said at least one notch and extending radially, therefrom, wherein, during assembly of said rigid central ring to said base, said at least one tab of said central ring peripheral wall is inserted into said at least one notch of said base peripheral wall, said at least one tab subsequently angularly rotated away from said notch in a direction toward a terminal end of said at least one undercut until said at least one tab is frictionally secured within said at least one undercut.

11. The anti-concussion collar assembly as recited in claim 1, further comprising:

an upper strengthening member disposed about said cowl body upper end, said upper strengthening member and an underlying area of said cowl body upper end having a plurality of spaced-apart apertures extending therethrough;

said rigid curved helmet attachment ring segment having a plurality of spaced-apart apertures extending through an interior surface thereof and in alignment with the plurality of spaced-apart apertures extending through said upper strengthening member and underlying area of said cowl body upper end; and a plurality of fasteners extending through the corresponding apertures in said upper strengthening member and said underlying area of said cowl body upper end, and the corresponding aligned plurality of spaced-apart apertures extending through the interior surface of said rigid curved helmet attachment ring segment.

12. The anti-concussion collar assembly as recited in claim 11, further comprising:

a lower strengthening member disposed about said cowl body lower edge, said lower strengthening member and an underlying area of said cowl body lower edge having a plurality of spaced-apart apertures extending therethrough;

said cowl support ring interior side having a plurality of spaced-apart apertures extending therethrough and in alignment with the plurality of spaced-apart apertures extending through said lower strengthening member and underlying area of said cowl body lower edge; and a plurality of fasteners extending through the corresponding apertures in said lower strengthening member and said underlying area of said cowl body lower edge, and the corresponding aligned plurality of spaced-apart apertures extending through the interior side of said cowl support ring.

13. The anti-concussion collar assembly as recited in claim 1, wherein annular-shaped rigid cowl support ring, said annular-shaped rigid central ring, said circular rolling element bearing, and said base are all concentric about a common longitudinal central axis.

* * * * *